US006164107A

United States Patent [19]

Korba, Jr.

[11] Patent Number: 6,164,107

[45] Date of Patent: Dec. 26, 2000

[54] RADIUS CRIMPING TOOL

[76] Inventor: William Korba, Jr., 9841 Glendale Rd., DeMotte, Lake County, Ind. 46310

[21] Appl. No.: 09/244,874

[22] Filed: Feb. 5, 1999

Related U.S. Application Data

[63] Continuation-in-part of application No. 08/764,446, Dec. 12, 1996, abandoned.

[51] Int. Cl.[7] ..... B21D 5/16; B21D 9/08

[52] U.S. Cl. ..... 72/31.1; 72/409.01; 72/385; 81/356; 81/358; 81/367

[58] Field of Search ..... 72/409.01, 409.13, 72/409.14, 461, 385, 31.1; 81/355, 356, 358, 365, 367, 372, 382, 384, 395, 398

[56] References Cited

U.S. PATENT DOCUMENTS

| | | | |
|---|---|---|---|
| 1,066,804 | 7/1913 | Falk | 72/409.01 |
| 1,284,993 | 11/1918 | Bellman | 72/409.01 |
| 1,729,556 | 9/1929 | Spear | 81/356 |
| 1,866,426 | 7/1932 | Siegrist | 81/356 |
| 2,313,270 | 3/1943 | Sapp | 81/358 |
| 2,591,649 | 4/1952 | Whiting | 72/409.01 |
| 2,592,679 | 4/1952 | Gedde | 72/409.01 |
| 2,826,106 | 3/1958 | Schegulla | 72/409.01 |
| 3,063,313 | 11/1962 | Ustin . | |
| 3,423,984 | 1/1969 | Keymer | 72/409.01 |
| 3,738,150 | 6/1973 | Holmes | 72/409.16 |
| 4,140,000 | 2/1979 | Ehmann | 72/114 |
| 4,177,664 | 12/1979 | Spors | 72/409.01 |
| 4,488,425 | 12/1984 | Meikle | 72/409.01 |
| 4,793,225 | 12/1988 | Berkich | 81/356 |
| 5,263,355 | 11/1993 | Malagnoux | 72/385 |
| 5,584,200 | 12/1996 | Andersen | 72/409.14 |

FOREIGN PATENT DOCUMENTS

| | | | |
|---|---|---|---|
| 796806 | 4/1936 | France | 72/409.01 |

*Primary Examiner*—Daniel C. Crane
*Attorney, Agent, or Firm*—Gary M. Hartman; Domenica N. S. Hartman

[57] ABSTRACT

A crimping tool capable of forming a uniform series of deformations or crimps on a workpiece, such that at least a portion of the workpiece can be modified to acquire an arcuate shape with a predetermined radius. The crimping tool includes a pair of arms and an associated pair of jaws. The tool further includes an adjustment feature associated with one of the arms for adjusting and gaging the distance between the jaws when in a crimping position. As such, the degree of deformation or crimping that can be applied by the jaws is positively limited by the adjustment feature, which physically establishes the minimum gap width between the jaws during a crimping operation. The jaws include die members specially configured to promote accurately placed and uniform crimps in a workpiece.

19 Claims, 6 Drawing Sheets

RADIUS CRIMPING TOOL

CROSS REFERENCE TO RELATED APPLICATIONS

This is a continuation-in-part patent application of U.S. patent application Ser. No. 08/764,446, filed Dec. 12, 1996, now abandoned.

BACKGROUND OF THE INVENTION

1. Field of the Invention

The present invention generally relates to plier-type tools. More particularly, this invention is directed to a handtool capable of forming a predeterminable deformation or crimp on a workpiece, such that the workpiece can be caused to have a desired accurate shape by applying a series of uniform crimps along an edge thereof.

2. Description of the Prior Art

Plier-type tools are well known in the art and have been used in a variety of applications to grip or apply a force to a workpiece. Generally, these tools include a pair of jaws that are rigidly or pivotably coupled to a corresponding pair of arms, and are typically operated in a scissor-like action by rotating the arms relative to each other so as to move the jaws toward and away from each other. Various plier-type tools have been suggested that offer a customized operation to perform a certain task. For example, plier-type tools have been proposed for the purpose of deforming workpieces, as disclosed in U.S. Pat. No. 4,809,534 to Osborn. Osborn suggests a plier-type tool for crimping a workpiece, whereby the force applied to the workpiece can be limited by a detent mechanism that generates a perceptible "break" in the handle when a degree of force is exerted upon the workpiece. Osborn's tool includes a fixed jaw secured to a stationary handle and a sliding jaw, connected to a pivoting handle, that slides perpendicular to the fixed jaw.

While Osborn's tool may be useful to form a series of relatively uniform deformations on a workpiece based on the ability to repeatably apply a limited force to the workpiece, nonuniformities within the workpiece and between workpieces of different construction and/or material will result in significant variations between deformations. As such, Osborn's tool is inadequate for applications where a predetermined crimp or deformation is desired, as is the case where a deformation or a uniform series of deformations or crimps are intended to impart a desired shape to a workpiece.

SUMMARY OF THE INVENTION

It is an object of this invention to provide a tool that is capable of imparting a predeterminable deformation on a workpiece.

It is another object of this invention that such a tool is a plier-type tool that is configured with a pair of jaws whose travel relative to each other can be selectively limited.

It is yet another object of this invention that such a tool is adapted to accurately deform a portion of a workpiece so as to create an arcuate shape having a predetermined radius.

It is a further object of this invention that such a tool is configured to enable a uniform series of crimps to be formed in a workpiece at predetermined intervals.

In accordance with a preferred embodiment of this invention, these and other objects and advantages are accomplished as follows.

The present invention provides a crimping tool that is capable of forming a uniform series of deformations or crimps on a workpiece, such that at least a portion of the workpiece can be modified to acquire an arcuate shape having a predetermined radius. Generally, the crimping tool of this invention includes a pair of arms and a corresponding pair of jaws. The arms are movable relative to each other such that a first of the arms has an open position and a closed position relative to the second arm. The jaws are associated with the first and second arms, such that a first of the jaws has an open position relative to the second jaw corresponding to the open position of the arms, and such that the first jaw has a crimping position relative to the second jaw corresponding to the closed position of the arms. The first jaw is disposed closer to the second jaw in the crimping position than when in the open position.

The tool of this invention further includes an adjustment feature associated with one of the arms for adjusting the distance between the pair of jaws when the first jaw is in the crimping position. As such, the degree of deformation or crimping that can be applied by the jaws is positively limited by the adjustment feature, which physically establishes the minimum gap width for the jaws during a crimping operation. The tool also includes a gage for accurately predetermining the gap width set by the adjustment feature. As such, the degree of deformation or crimping applied by the jaws can be accurately predetermined by appropriately adjusting the gap width of the jaws when in the crimping position. In so doing, a workpiece can be worked to acquire a particular shape, such as an arcuate shape, by appropriately selecting the size of each crimp formed on the workpiece. In accordance with a preferred embodiment of this invention, the tool also includes a graduated member mounted to one of the jaws, with the graduated member being configured to measure the distance between crimps on a workpiece. A uniform series of crimps can therefore be more readily formed along an edge of a workpiece, such that the workpiece is modified to have an arcuate shape with a predetermined radius.

From the above, it can be seen that, with the handtool of this invention, the amount of crimping applied to a workpiece and the spacing between crimps can be selected to achieve a desired amount of curvature imparted to the workpiece. With this handtool, one skilled in the art would be readily able to vary the degree of crimping and vary the spacing between crimps to impart a desired shape to a workpiece. An example is framing angle metal, which often must be uniformly bent to acquire an arcuate shape for doorways and other structural features of a building.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
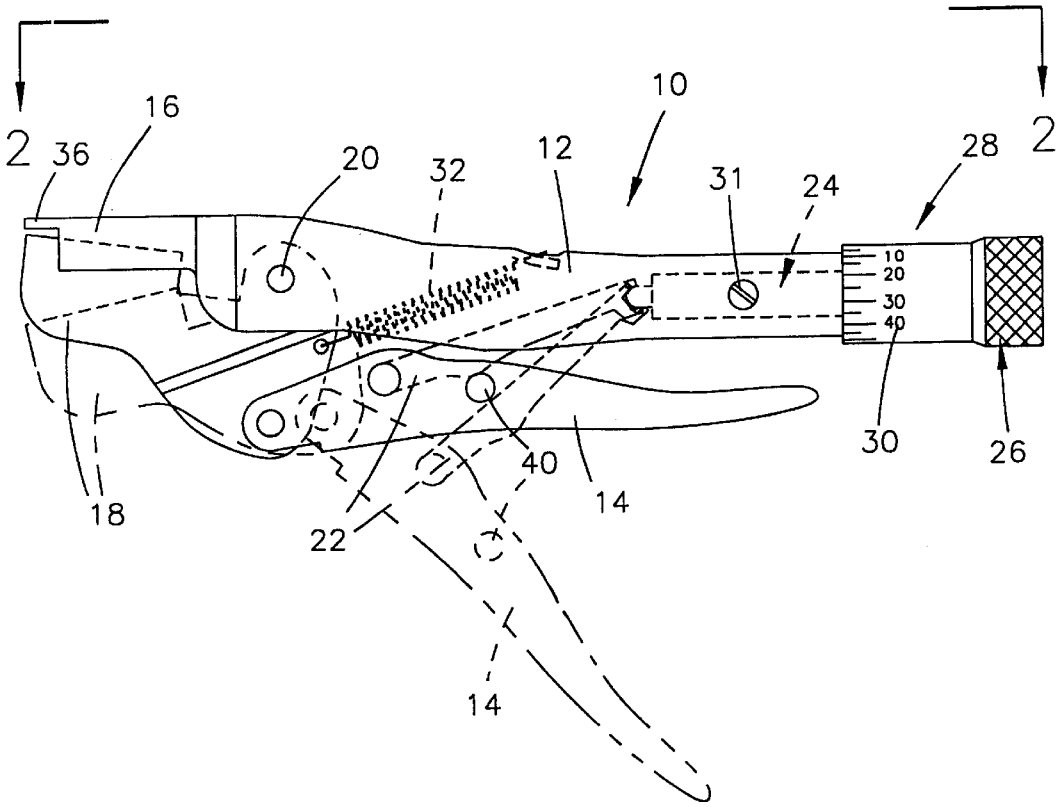
FIG. 1 shows a side view of a crimping tool in accordance with a first embodiment of this invention.

As shown in FIG. 1, a first embodiment of a crimping tool 10 in accordance with this invention is a plier-type handtool that includes a pair of arms 12 and 14 and a pair of jaws 16 and 18. One jaw 16 is generally fixed to the arm 12, while the other jaw 18 is pivotable relative to the jaw 16 as a result of a pivot pin 20 that secures the jaws 16 and 18 together. The tool 10 is generally configured to be constructed similar to that of a handtool commercially available under the trademark "VISE-GRIP," and could foreseeably be formed by appropriately modifying a VISE-GRIP tool. With such a construction, one arm 14 is pivotably connected to the jaw 18, which in turn is interconnected to the arm 12 via a coil spring 32. The arm 14 is further interconnected with the other arm 12 via a link 22. In a conventional VISE-GRIP type tool, the spring 32 would cause the arm 14 to be bistable between an open position (shown in phantom in FIG. 1) and a closed position relative to the second arm 12, corresponding to open and closed positions, respectively, for the jaws 16 and 18. However, as shown in FIG. 1, the tool 10 also includes a stop 40 that abuts the arm 12 in the closed position so as to prevent the arm 14 from locking into the closed position. As a result, the arm 14 is continuously biased toward the open position by the spring 32, and can only be maintained in the closed position by the user holding the arms 12 and 14 together. The jaws 16 and 18 are shown as forming female and male dies, respectively, whose shapes and size can vary from that shown to create a particular crimp size and/or shape, or to form crimps on different types of materials.

The tool 10 also includes an adjustment feature 28 for adjusting the spacing between the jaws 16 and 18 when the arms 12 and 14 are held by the user in the closed position. According to this embodiment of the invention, the adjustment feature 28 is located at the end of the arm 12, and is structured similarly to a micrometer. The adjustment feature 28 includes a threaded shaft 24 that extends coaxially through the arm 12. The shaft 24 is coupled with the link 22, such that the end of the link 22 moves toward or away from the jaws 16 and 18 when the shaft 24 is threaded into or out of the arm 12, respectively. As is apparent from FIG. 1, altering the position of the link 22 along the length of the arm 12 causes the jaw 18 to pivot relative to the jaw 16 about the pin 20, which in turn causes the spacing between the jaws 16 and 18 to change when the arm 14 is held by the user in the closed position.

Figure 2:
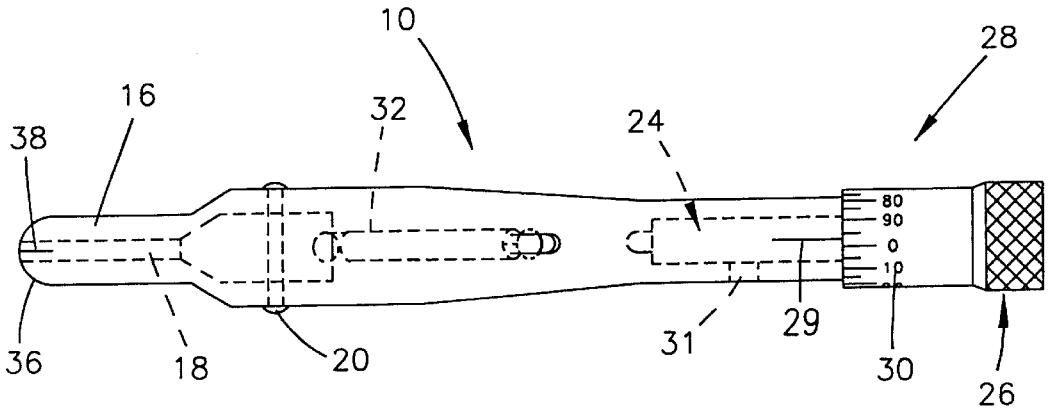
FIG. 2 is a top view of the crimping tool of FIG. 1.

As seen in FIGS. 1 and 2, a housing 26 is attached to the end of the shaft 24 furthest from the jaws 16 and 18. In order to enable the shaft 24 to accurately set the distance between the jaws 16 and 18 when the arm 14 is in the closed position, the adjustment feature 28 incorporates a gaging system. This system includes an alignment mark 29 formed on the arm 12 that the user aligns with one of a number of settings 30 indicated along the exterior circumference of the housing 26, as one would do when operating a micrometer. The settings 30 correspond to different radius settings based on a given spacing between crimps on a workpiece. For example, with the jaw configuration shown, aligning the mark 29 with a particular setting 30 would produce a radius in a workpiece of about fifty feet (about fifteen meters) when crimps are spaced about three inches (about 7.6 centimeters) apart. As seen from FIGS. 1 and 2, aligning the mark 29 on the arm 12 with a setting 30 that necessitates threading the shaft 24 toward the jaws 16 and 18 would provide for a larger gap width between the jaws 16 and 18 as compared to when the mark 29 is aligned with a setting 30 that requires threading the shaft 24 away from the jaws 16 and 18.

In use, a user determines the radius required for a workpiece, selects a spacing distance between crimps (e.g., three inches), and makes appropriate spaced markings along the length of the workpiece. To assist in accurately forming crimps at each of the spaced markings, the upper jaw 16 is formed to have a flange 36 on which is provided an alignment mark 38 that enables relatively precise alignment of the jaw 16 with a scribe mark on a workpiece. A chart can be used to correlate the settings 30 with multiple radii based on different spacings between crimps on a workpiece. The user then rotates the housing 26 to align the appropriate setting 30 with the mark 29 on the arm 12, to obtain the desired radius based on the chosen crimp spacing. A set screw 31 threaded into the arm 12 enables the shaft 24 to be locked in place once the desired adjustment is made using the mark 29 and settings 30.

According to this invention, the above configuration for the tool 10 enables the adjustment feature 28 to be calibrated by the user in reference to the distance between crimps formed on a workpiece. In other words, by correlating the spacing between the jaws 16 and 18 (as determined by the adjustment feature 28) and the spacing between crimps, a preselected amount of curvature can be accurately imparted to a workpiece, such as a framing angle metal. Notably, without the adjustment feature 28, a user would be required to resort to repeated adjustments and hand measurements in order to achieve a desired gap between the jaws 16 and 18. As such, switching between different jaw gap widths would require the user to continuously readjust and remeasure the jaw width, with a considerably greater chance of error, and possibly leading to a misshaped crimp and workpiece.

Figure 3:
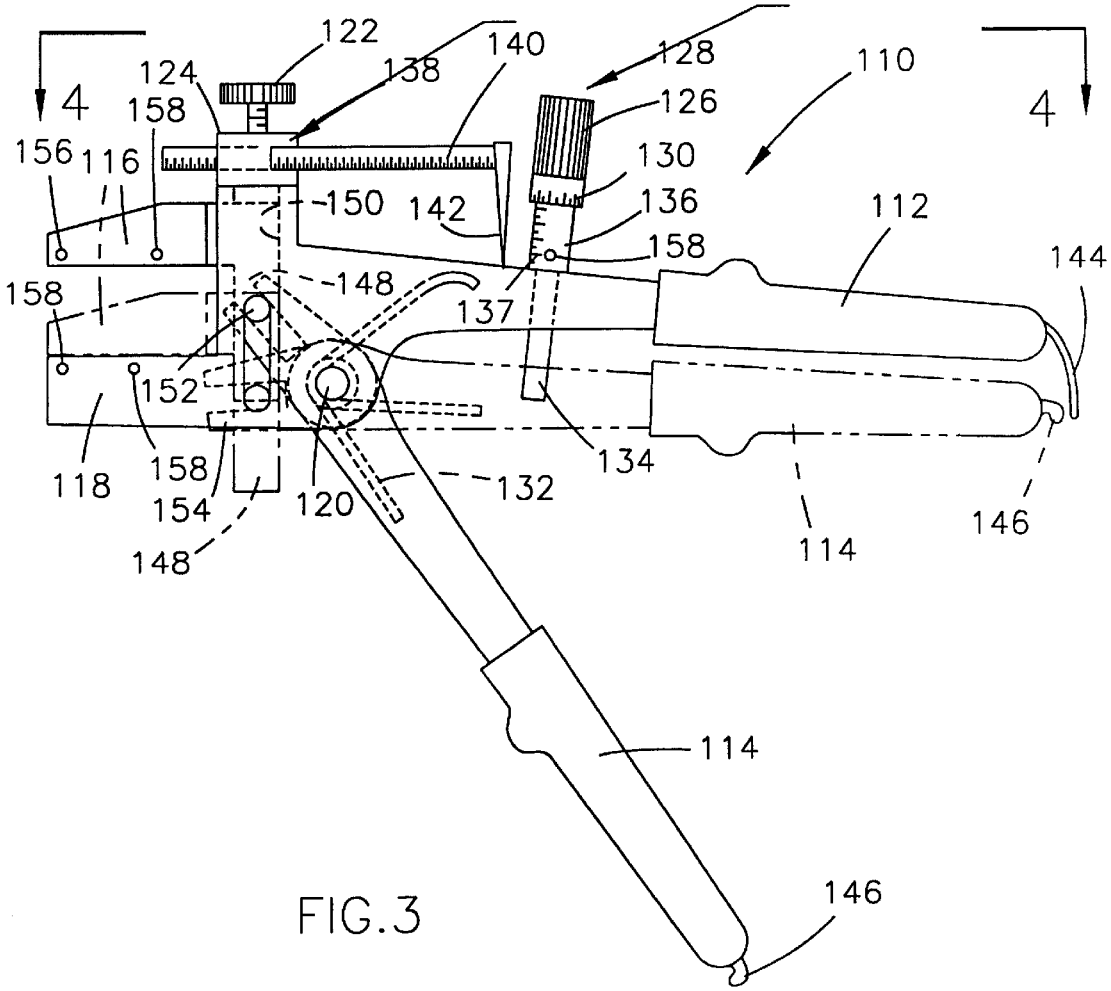
FIG. 3 shows a view of a crimping tool in accordance with a second embodiment of this invention.
Figure 4:
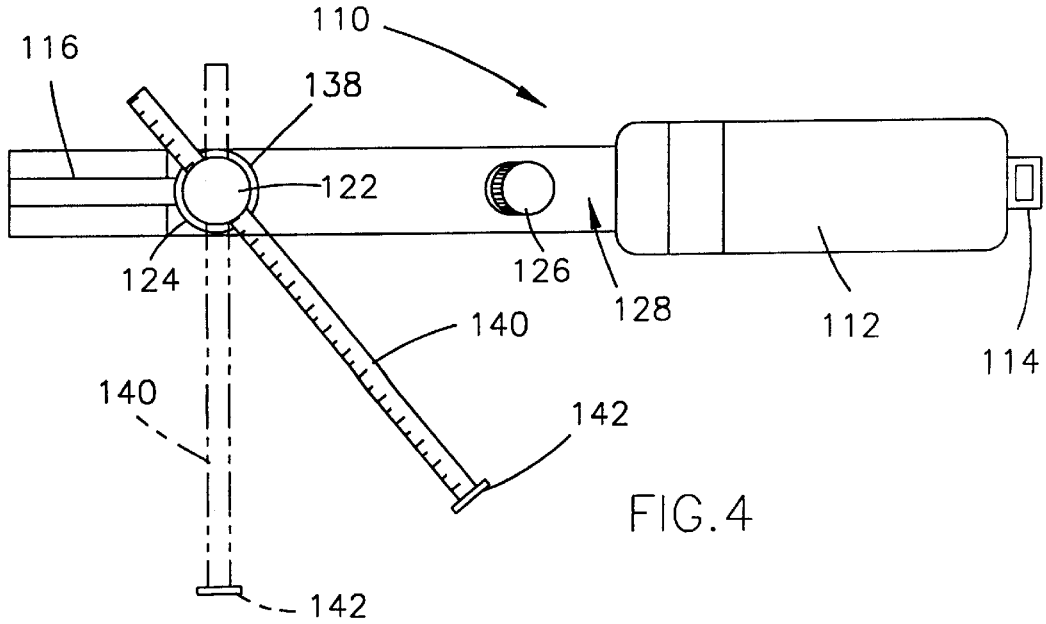
FIG. 4 shows a top view of the crimping tool of FIG. 3.

A tool 110 in accordance with a second embodiment of this invention is shown in FIGS. 3 and 4. This tool 110 also includes a pair of arms 112 and 114 and jaws 116 and 118. As shown, the jaw 118 is fixed relative to the arm 112, contrary to that of the first embodiment of FIGS. 1 and 2. The arm 114 is pivotably connected to the arm 112 by a pin 120, such that the arm 114 is movable between an open position and a closed position, the latter shown in phantom in FIG. 3. The arm 114 is shown being urged toward an open position relative to the arm 112 by a coil spring 132, though one skilled in the art could substitute other biasing means for the spring 132. The arm 114 includes a yoke 154 that is pivotably and slidably coupled to a pin 152 secured to a portion of the jaw 116, shown as a piston 148 that is slidably received within a bore 150 in the jaw 118. As such, the jaws 116 and 118 do not rotate relative to each other, but instead the jaw 116 moves in a straight-line motion relative to the jaw 118.

As with the tool 10 of FIGS. 1 and 2, dies (not shown) are secured to the jaws 116 and 118 with apertures 156 and 158, which may be threaded to receive screws that secure the dies to the jaws 116 and 118. The tool 110 also includes a latch 144 and hook 146 provided on the arms 112 and 114, respectively, which enable the tool 110 to be retained in the closed position for storage.

According to this embodiment of the invention, the degree of crimping applied to a workpiece is adjusted by an adjustment feature 128 mounted to extend through the arm 112. The adjustment feature 128 includes a shaft 134 that extends through the arm 112 to abut the other arm 114 when in the closed position, such that the minimum gap width between the jaws 116 and 118 is positively established. The shaft 134 is threadably received in a sleeve 136 mounted to the arm 112, and includes a knurled head 126 by which the shaft 134 can be readily threaded into and out of the sleeve 136. The adjustment feature 136 also includes graduated lines 130 and 137 on the head 126 and sleeve 136, respectively, such that the feature 128 can be operated in a manner essentially identical to a micrometer. Finally, a set screw 158 is provided with which the position of the shaft 134 within the sleeve 136 can be maintained.

With reference to FIGS. 3 and 4, the tool 110 of this embodiment also enables crimps applied to a workpiece to be accurately spaced apart with a spacing device 138 that is mounted on the jaw 118. The device 138 includes a graduated ruler 140 that is received in an opening in a rotatable post 124 on the jaw 118. The ruler 140 can be readily adjusted within the post 124 by loosening and tightening a fastener 122 that is threaded into the post 124 to engage the ruler 140. As shown, the ruler 40 can be oriented to measure a distance in a direction perpendicular to the gap between the jaws 116 and 118, and therefore laterally relative to a crimp formed by the jaws 116 and 118. The spacing device 138 also includes a pointer 142 attached to one end of the ruler 140, which further aids the user in accurately measuring the distance between each crimp applied to a workpiece. According to this invention, the above configuration for the tool 110 enables the adjustment feature 128 and the spacing device 138 to be calibrated by the user, or through a standardized chart, to correlate the spacing between jaws 116 and 118 and the spacing between crimps. Together, these settings can be preselected and used to determine the amount of curvature imparted to a workpiece, such as a framing angle metal.

Figure 5:
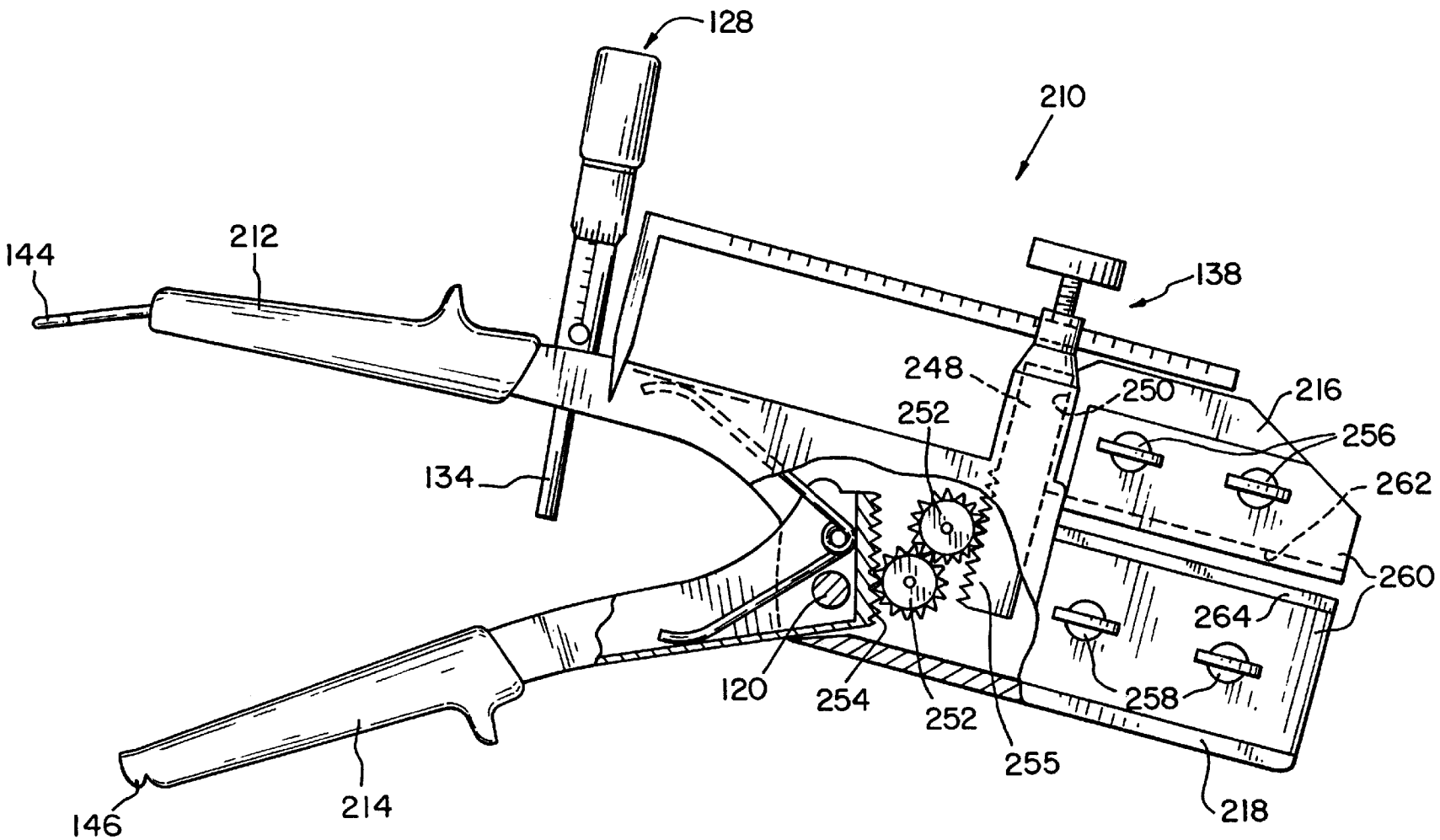
FIGS 5 and 6 are side views of crimping tools in accordance with third and fourth embodiments, respectively, of this invention.

A third embodiment shown in FIG. 5 is similar to that of FIGS. 3 and 4, in that a crimping tool 210 is shown as including an adjustment feature 128 and spacing device 138 that are structurally and functionally identical to the adjustment feature 128 and spacing device 138 of the second embodiment of FIGS. 3 and 4. Various other features of the tool 210 of FIG. 5 are shown as being identified with the same reference numbers as those used in FIGS. 3 and 4, denoting that these features are functionally identical to the identically-numbered features of the tool 110. FIG. 5 also shows two pairs of pins 256 and 258 that serve to secure a pair of dies 260 to the jaws 216 and 218, respectively. As shown the die 260 on the jaw 216 has a channel 262 formed therein that receives a rib 264 on the die 260 secured to the jaw 218. Together, the channel 262 and rib 264 are sized to form a crimp on a workpiece in accordance with this invention.

An important difference between the tools 110 and 210 is that the arm 214 of the tool 210 is not formed to have a yoke 154, but instead is equipped with a rack 254 that communicates through a pair of pinions 252 to a rack 255 formed on a piston 248. As with the piston 148 of FIGS. 3 and 4, the piston 248 of this embodiment is slidably received within a bore 250 within the jaw 216. As such, rotation of the arm 214 relative to the arm 212 causes the jaws 216 and 218 to move in a straight-line motion relative to each other. The use of the gear system between the arm 214 and the jaw 218 enables this tool 210 to be used for relatively thick and/or hard workpieces.

Figure 6:
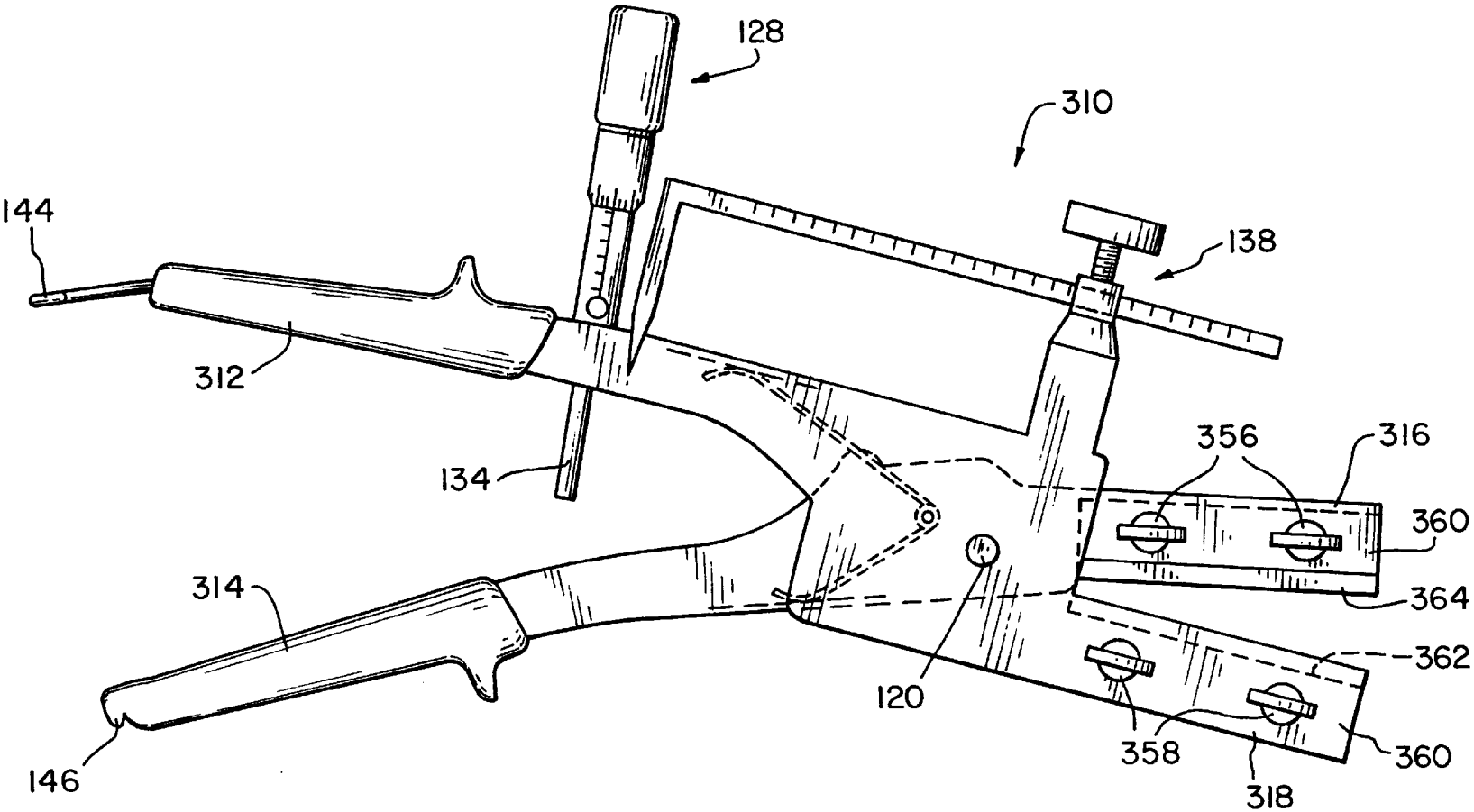

A fourth embodiment of a tool 310 in accordance with this invention is shown in FIG. 6, and has a construction more similar to a standard plier-type tool. However, the tool 310 retains basic features of this invention incorporated in the embodiments of FIGS. 3 through 5, as denoted by the use of the same reference numbers to identify features that are functional equivalents to the identically-numbered features of the tools 110 and 210. However, the tool 310 shown in FIG. 6 has a scissor-like operation, with the jaws 316 and 318 being rigidly fixed to the arms 312 and 314, respectively, and being pivotable on a pin 320. As before, the tool 310 includes the adjustment feature 128 and measuring member 138 of this invention that enable a uniform series of crimps to be formed in a workpiece, enabling the tool 310 to impart a predetermined shape to the workpiece. In addition, pins 356 and 358 serve to secure a pair of dies 360 to the jaws 316 and 318, respectively. In this embodiment, a channel 362 is provided on the jaw 318 and its mating rib 364 is provided on the jaw 316. This tool 310 would be typically used for thinner or more ductile metal as compared to the tools 10, 110 and 210 of FIGS. 1 through 5.

A fifth and preferred embodiment of a tool 510 in accordance with this invention is shown in FIGS. 7 through 10. This tool 510 has a construction similar to the tool 10 of FIGS. 1 and 2. For example, the tool 510 includes a pair of arms 512 and 514 and a pair of jaws 516 and 518, with the upper jaw 516 being fixed to the upper arm 512 and the lower jaw 518 being pivotably attached to the upper jaw 516 with a pin 520. A second pin 521 pivotably connects the lower arm 514 to the lower jaw 518, which is connected to the upper arm 512 with a coil spring 532. A link 522 attached to the lower arm 514 with a third pin 523 interconnects the lower arm 514 with the upper arm 512. The spring 532 and link 522 cause the lower arm 514 to be bistable between an open position (shown in FIG. 7) and a closed position relative to the upper arm 512, corresponding to open and closed positions, respectively, for the jaws 516 and 518.

Figure 7:
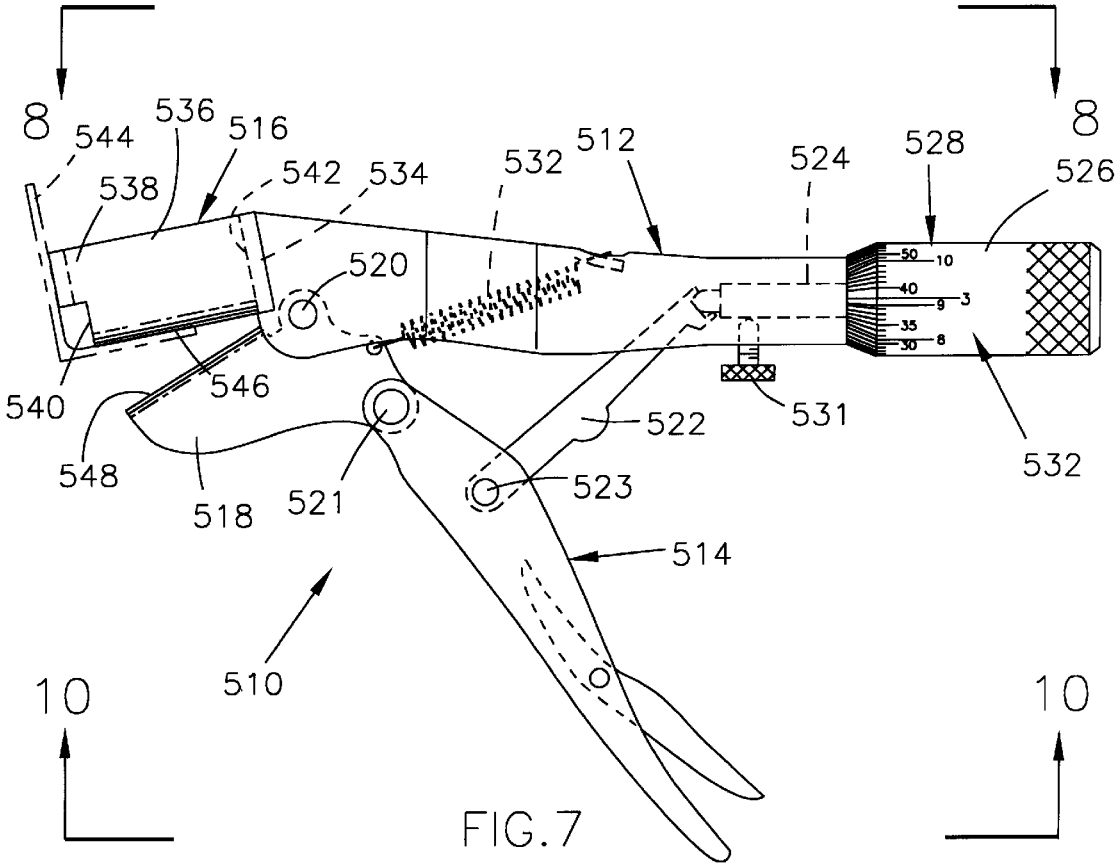
FIG. 7 shows a side view of a crimping tool in accordance with a preferred embodiment of this invention.

As with the embodiment of FIGS. 1 and 2, the jaws 516 and 518 are shown as being equipped with female and male dies, respectively. In the preferred embodiment of FIGS. 7 through 10, the jaws 516 and 518 are specially configured to produce a more uniform and repeatable crimp than that possible with the tools of the previous embodiments. As seen most readily from FIGS. 8 and 9, the upper jaw 516 has a base wall 534, an intermediate portion defined by a pair of spaced-apart parallel walls 536, and an arcuate nose portion 538 with a notch 540. As shown in FIG. 7, the nose portion 538 serves to position the tool 510 on a workpiece 544 (shown as a framing angle metal) placed between the jaws 516 and 518, so as to more consistently locate a series of crimps relative to the intersection of the two legs of the workpiece 544 intersect. As evident from FIG. 8, the walls 534 and 536 and the nose portion 538 of the upper jaw 516 define an opening 542 that permits the user to view the lower jaw 518 and the workpiece 544, which further promotes the accurate placement of a crimp on the workpiece 544.

Figure 8:
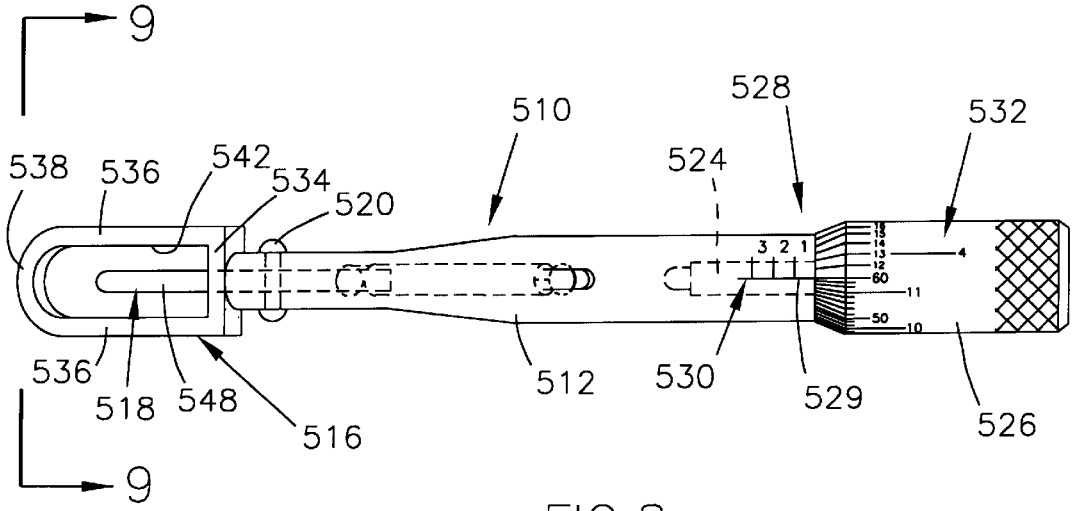
FIGS. 8 and 9 are top end views, respectively, of the crimping tool of FIG. 7.
Figure 9:
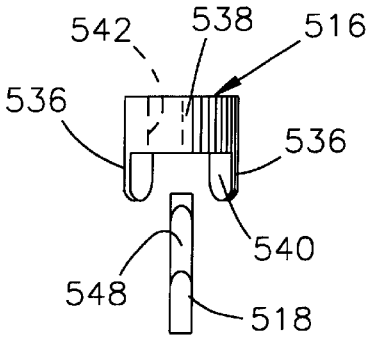
Figure 10:
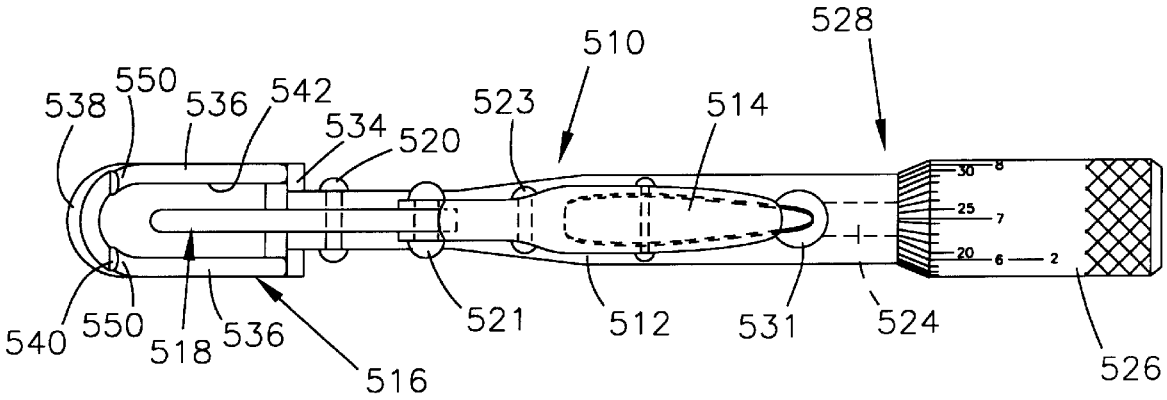
FIG. 10 is a bottom view of the crimping tool of FIG. 7.

From FIGS. 7 and 9, it can be seen that the bottom edges 546 of the walls 536 are what apply the force of the upper jaw 516 to the upper surface of the workpiece 544, while an upper edge 548 of the lower jaw 518 engages that portion of the workpiece 544 between the edges 546. Due to the presence of the notch 540, the nose portion 538 does not engage the workpiece 544 when positioned between the jaws 516 and 518. The edge 548 of the lower jaw 518 is much narrower than the width of the opening 542 in the upper jaw 516, and preferably less than half the width of the opening 542 in order to provide adequate lateral clearance between the edges 546 and 548 when the jaws 516 and 518 are closed. In addition, the distal end of the lower jaw 518 is preferably approximately aligned with the notch 540 in the upper jaw 516, such that the edges 546 and 548 of the jaws 516 and 518 are approximately equal in length, as evident from FIGS. 7, 8 and 10. The edges 546 and 548 are also preferably equal in width and rounded as shown instead of angular. Finally, as best seen in FIG. 10, the terminal end 550 of each edge 546 nearest the distal end of the jaw 516 curves slightly inward towards the other edge 546, as a result of the notch 540 being formed within the arcuate nose portion 538 and not in the parallel walls 536. Otherwise, the edges 546 and 548 are substantially parallel to each other.

According to this embodiment of the invention, the spacing, widths and rounded contours of the working surfaces formed by the edges 546 and 548 and the curved end portions of the edges 546 cooperate to produce crimps that are more consistently uniform than that possible with sharp or angular edges (e.g., the embodiments of FIGS. 1 through 6), which produce crimps that appear similar to sharp creases. The ability of the tool 510 to produce consistently uniform crimps is extremely important for creating a uniformly accurate shape in the workpiece 544. The terminal ends 550 of the edges 546 are particularly worth noting for their effect on the consistency and uniformity of the crimps. Without the inwardly-curved shape of the terminal ends 550, a crimp formed by the tool 510 tends to extend beyond the edges 546 toward the interior corner of the workpiece 544, and creates an unwanted bulge in the lower surface of the workpiece 544.

The tool 510 also includes an adjustment mechanism 528 for adjusting the spacing between the jaws 516 and 518 when the arms 512 and 514 are in the closed position. Similar to the embodiment of FIGS. 1 and 2, the adjustment mechanism 528 is located at the end of the upper arm 512, and is structured similarly to a micrometer. The adjustment mechanism 528 includes a cap 526 and threaded shaft 524, the latter of which extends coaxially within the arm 512. The shaft 524 is coupled with the link 522, such that the end of the link 522 moves toward or away from the jaws 516 and 518 when the shaft 524 is threaded into or out of the arm 512, respectively. As is apparent from FIG. 7, altering the position of the link 522 along the length of the arm 512 causes the jaw 518 to pivot relative to the jaw 516 about the pin 520, which in turn causes the spacing between the jaws 516 and 518 to change when the arm 514 is in the closed position. A set screw 531 threaded into the arm 512 enables the shaft 524 to be locked in place once the desired adjustment is made with the mechanism 528. The set screw 531 is located between the arms 512 and 514 so as not to hinder the use of the tool 510 by both left-handed and right-handed users.

In order to accurately set the distance between the jaws 516 and 518 when in the closed position, the cap 526 and arm 512 are equipped with graduated markings, as best seen in FIG. 8. The arm 512 and cap 526 are each shown as having three series of marks 530 and 532, respectively. The marks 530 on the arm 512 are placed along an alignment mark 529. The shortest marks 532 on the cap 526 (with their numbers closest to the arm 512, e.g., "60") are used in conjunction with the first mark ("1") on the arm 512, the marks 532 of intermediate length (e.g., "11") are used in conjunction with the second mark ("2") on the arm 512, and the longest marks 532 (with their numbers farthest from the arm 512, e.g., "4") are used in conjunction with the third mark ("3") on the arm 512. According to this embodiment of the invention, the numbers designated on the cap 526 indicate the diameter that will be produced with that setting if crimps are formed a predetermined distance apart in the workpiece 544, e.g., three inches (about 7.6 centimeters) apart. For example, in the setting shown in FIG. 8, the mark 532 designated as "60" is aligned with the alignment mark 529 on the arm 512 because the edge of the cap 526 is within the first mark ("1") on the arm 512. Using this setting, forming crimps spaced three inches apart on the workpiece 544 produces a diameter in the workpiece 544 of about sixty feet (about 18.3 meters). In order to promote the precision with which radii can be produced with the tool 510, the pins 520, 521 and 523 are formed to have minimal clearances with the holes in which they are received.

With each of the embodiments described above, the user of a tool configured in accordance with this invention is able to apply a uniform series of substantially identical crimps to a workpiece. One application in which such a tool is useful is where a series of crimps must be formed along an edge of a straight workpiece to impart an arcuate shape to the workpiece, as is the case with framing angle metal (workpiece 544 of FIG. 7) used in the construction of buildings. The user of one of these tools would first determine the amount of curvature desired, and then adjust the tool to limit the travel of the jaws so that a desired crimp is applied to the workpiece.

While this invention has been described in terms of a preferred embodiment, it is apparent that other forms could be adopted by one skilled in the art, for example, by modifying the appearance or structure of the tool, or combining or interchanging certain features of the various tools. Accordingly, the scope of our invention is to be limited only by the following claims.

What is claimed is:

1. A tool for producing a crimp in a workpiece, the tool comprising:

a first arm;

a second arm movable relative to the first arm;

a first jaw rigidly connected to the first arm;

a second jaw pivotably connected to the second arm and pivotably connected to the first jaw, the first and second jaws having a closed position relative to each other wherein the first and second jaws are proximate each other;

the first and second jaws having complementary die members, a first of the die members comprising a pair of spaced-apart edges, a second of the die members comprising an edge that is aligned between the spaced-apart edges when the first and second jaws are in the closed positioned; and a distal member at a distal end of the first of the die members and interconnecting the pair of spaced-apart edges, the distal member having a notch formed therein such that the distal member does not engage a portion of a workpiece positioned between the first and second jaws.

2. A tool as recited in claim 1, further comprising means associated with the first arm for adjusting and gaging a gap width between the first and second jaws when the first and second jaws are in the closed position.

3. A tool as recited in claim 2, wherein the adjusting and gaging means comprise a graduated member threadably mounted to the first arm.

4. A tool as recited in claim 2, wherein the adjusting and gaging means comprise:

a link pivotably interconnecting the second arm with the first arm;

a threaded rod disposed within the first arm, the threaded rod being coupled with the link such that rotation of the threaded rod causes the link to move along the first arm;

a cap attached to the threaded rod;

an alignment mark on the first arm;

graduated markings along the alignment mark; and graduated markings on the cap.

5. A tool as recited in claim 4, wherein the graduated markings along the alignment mark and the graduated markings on the cap are present in equal numbers of sets.

6. A tool as recited in claim 1, wherein the spaced-apart edges of the first of the die members and the edge of the second of the die members are approximately equal in length.

7. A tool as recited in claim 1, wherein the spaced-apart edges of the first of the die members and the edge of the second of the die members are rounded and approximately equal in width.

8. A tool as recited in claim 1, wherein the spaced-apart edges of the first of the die members and the edge of the second of the die members are approximately parallel to each other.

9. A tool as recited in claim 1, wherein each of the spaced-apart edges has a terminal end nearest the distal member that curves slightly toward the other spaced-apart edge.

10. A tool as recited in claim 1, wherein the spaced-apart edges define an opening therebetween through which the second of the die members is visible.

11. A tool as recited in claim 1, wherein the second of the die members has a width less than half a width of the opening.

12. A tool for producing a crimp in a workpiece, the tool comprising:

a first arm;

a second arm movable relative to the first arm;

a first jaw formed at an end of the first arm, the first jaw having a first die member comprising a base wall, a pair of spaced-apart walls extending approximately parallel from the base wall, and an arcuate portion interconnecting the spaced-apart walls opposite the base wall, the spaced-apart walls defining two approximately parallel and rounded spaced-apart edges, each of the spaced-apart edges having a terminal end nearest the arcuate portion that curves slightly toward the other spaced-apart edge;

a second jaw pivotably connected to the second arm and pivotably connected to the first jaw, the first and second jaws having a closed position relative to each other wherein the first and second jaws are proximate each other, the second jaw having a second die member comprising a single rounded edge that is approximately parallel to and aligned between the spaced-apart edges of the first die member when the first and second jaws are in the closed positioned;

a link pivotably interconnecting the second arm with the first arm; and a graduated mechanism mounted to the first arm for adjusting and gaging a gap width between the first and second jaws when the first and second jaws are in the closed position, the graduated mechanism comprising a threaded rod disposed within the first arm and coupled with the link such that rotation of the threaded rod causes the link to move along the first arm, a longitudinal alignment mark on the first arm, graduated markings along the alignment mark, a cap attached to the threaded rod, and circumferential graduated markings on the cap, the graduated markings along the alignment mark and the graduated markings on the cap being present in equal numbers of sets, the graduated markings on the cap indicating a diameter defined in a workpiece when crimped with the tool.

13. A tool as recited in claim 12, further comprising means for causing a bistable operation of the second arm relative to the first arm.

14. A tool as recited in claim 12, wherein the spaced-apart edges of the first die member and the edge of the second die member are approximately equal in length.

15. A tool as recited in claim 12, wherein the spaced-apart edges of the first die member and the edge of the second die member are approximately equal in width.

16. A tool as recited in claim 12, wherein the arcuate member has a notch formed therein adjacent the spaced-apart edges such that the arcuate member does not engage a portion of a workpiece positioned between the first and second jaws.

17. A tool as recited in claim 12, wherein the spaced-apart edges define an opening therebetween through which the edge of the second die member is visible.

18. A tool as recited in claim 17, wherein the edge of the second die member has a width less than half a width of the opening.

19. A tool as recited in claim 12, further comprising a set screw threaded into the first arm and operable to immobilize the threaded rod within the first arm.

* * * * *